US009543099B2

(12) United States Patent
An

(10) Patent No.: US 9,543,099 B2
(45) Date of Patent: Jan. 10, 2017

(54) DIRECT CURRENT RELAY

(71) Applicant: LSIS CO., LTD., Anyang-si, Gyeonggi-do (KR)

(72) Inventor: Jung Sik An, Seoul (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/746,732

(22) Filed: Jun. 22, 2015

(65) Prior Publication Data

US 2016/0093458 A1 Mar. 31, 2016

Related U.S. Application Data

(60) Continuation of application No. 13/363,632, filed on Feb. 1, 2012, now Pat. No. 9,093,719, which is a (Continued)

(30) Foreign Application Priority Data

Sep. 29, 2014 (KR) ..... 20-2014-0007089 U

(51) Int. Cl.
*H01H 67/02* (2006.01)
*H01H 50/38* (2006.01)
(Continued)

(52) U.S. Cl.
CPC ..... *H01H 50/38* (2013.01); *H01H 9/443* (2013.01); *H01H 50/18* (2013.01); *H01H 50/54* (2013.01);
(Continued)

(58) Field of Classification Search
CPC ..... H01H 50/04; H01H 50/18; H01H 50/44; H01H 50/56; H01H 50/64; H01H 50/645; H01H 2007/086; H01H 51/04; H01H 51/20; H01H 9/44; H01H 9/443; H01H 9/446; H01H 73/18; H01H 2001/545; H01F 7/02; H01F 7/0278
(Continued)

(56) References Cited

U.S. PATENT DOCUMENTS 2,446,859 A * 8/1948 Traver ..... H01H 9/446 218/148
2,728,880 A 12/1955 Ashworth
(Continued)

FOREIGN PATENT DOCUMENTS

CN 103515153 1/2014
JP 56-29818 3/1981
(Continued)

OTHER PUBLICATIONS

European Patent Office Application Serial No. 15173331.8, Search Report dated Feb. 15, 2016, 7 pages.
(Continued)

*Primary Examiner* — Shawki S Ismail
*Assistant Examiner* — Lisa Homza
(74) *Attorney, Agent, or Firm* — Lee, Hong, Degerman, Kang & Waimey

(57) ABSTRACT

The present invention relates to a direct current relay, and more particularly, to a direct current relay capable of reducing an electronic repulsive force generated between a fixed contact and a movable contact by a permanent magnet installed to extinguish an arc. The direct current relay includes: a frame; first and second fixed contacts spaced from each other with a predetermined distance there between; first and second magnetic substances formed to enclose a lower part of the first and second fixed contacts; a movable contact movable to contact or to be separated from the first and second fixed contacts, having a first movable contact contactable to the first fixed contact, and having a
(Continued)

second movable contact contactable to the second fixed contact; and a pair of permanent magnets installed on long sides of the frame.

6 Claims, 6 Drawing Sheets

Related U.S. Application Data division of application No. 12/223,950, filed as application No. PCT/KR2007/000809 on Feb. 15, 2007, now abandoned.

(51) Int. Cl.

| | |
|---|---|
| ***H01H 9/44*** | (2006.01) |
| ***H01H 50/54*** | (2006.01) |
| ***H01H 50/18*** | (2006.01) |
| ***H01H 51/22*** | (2006.01) |
| *H01H 1/54* | (2006.01) |

(52) U.S. Cl.
CPC ..... *H01H 50/546* (2013.01); *H01H 51/2209* (2013.01); *H01H 2001/545* (2013.01); *H01H 2051/2218* (2013.01); *H01H 2201/008* (2013.01); *H01H 2201/03* (2013.01)

(58) Field of Classification Search
USPC ..... 335/136
See application file for complete search history.

(56) References Cited

U.S. PATENT DOCUMENTS 4,570,139 A * 2/1986 Kroll ..... H01H 1/0036 335/128
5,003,137 A * 3/1991 Tateishi ..... H01H 9/36 218/151
5,175,524 A * 12/1992 Gotoh ..... H01H 51/065 335/126
5,394,128 A 2/1995 Perreira et al.
5,563,563 A * 10/1996 Freitas ..... H01H 1/04 335/126
7,551,049 B2 * 6/2009 Hirabayashi ..... H01H 51/065 335/106
7,859,373 B2 * 12/2010 Yamamoto ..... H01H 50/305 335/126
7,876,183 B2 * 1/2011 Uruma ..... H01H 50/04 335/126
8,310,323 B2 * 11/2012 Niimi ..... H01H 50/023 335/131
2004/0027776 A1 * 2/2004 Uotome ..... H01H 47/06 361/160
2005/0156469 A1 7/2005 Nishida et al.
2009/0066450 A1 * 3/2009 Yano ..... H01H 49/00 335/203
2009/0322455 A1 * 12/2009 Yoshihara ..... H01F 7/1615 335/189
2011/0240603 A1 10/2011 Hoffmann et al.
2013/0012037 A1 * 1/2013 Enomoto ..... H01H 9/443 439/39
2013/0057369 A1 * 3/2013 Yano ..... H01H 1/66 335/156
2013/0169389 A1 * 7/2013 An ..... H01H 50/163 335/207
2013/0321107 A1 * 12/2013 Palanisamy ..... H01H 1/2025 335/179
2013/0335175 A1 12/2013 Tachikawa et al.
2014/0184366 A1 * 7/2014 Ito ..... H01H 50/54 335/189
2014/0360985 A1 * 12/2014 Takaya ..... H01H 50/02 218/156
2015/0022291 A1 * 1/2015 Kashimura ..... H01H 9/443 335/131
2015/0022292 A1 * 1/2015 Tachikawa ..... H01H 50/54 335/131
2015/0054604 A1 * 2/2015 Kubono ..... H01H 50/36 335/177
2015/0054605 A1 * 2/2015 Kubono ..... H01H 50/60 335/177
2015/0123753 A1 * 5/2015 Kawaguchi ..... H01H 50/20 335/203
2015/0255235 A1 * 9/2015 Nishimura ..... H01H 50/60 335/187
2016/0012993 A1 * 1/2016 Sasaki ..... H01H 50/20 335/203
2016/0079022 A1 * 3/2016 An ..... H01H 9/30 335/187

FOREIGN PATENT DOCUMENTS

| | | |
|---|---|---|
| JP | 2012146634 | 8/2012 |
| JP | 2013038683 | 2/2013 |
| JP | 2013140796 | 7/2013 |
| JP | 2013243110 | 12/2013 |
| WO | 2009/071871 | 6/2009 |

OTHER PUBLICATIONS

Japan Patent Office Application Serial No. 2015-136722, Notice of Allowance dated Sep. 6, 2016, 2 pages.

* cited by examiner

DIRECT CURRENT RELAY

CROSS-REFERENCE TO RELATED APPLICATION

Pursuant to 35 U.S.C. §119(a), this application claims the benefit of earlier filing date and right of priority to Korean Patent Application No. 20-2014-0007089, filed on Sep. 29, 2014, the contents of which are all hereby incorporated by reference herein in its entirety.

BACKGROUND OF THE INVENTION

1. Field of the Invention

The present invention relates to a direct current relay, and more particularly, to a direct current relay capable of reducing an electronic repulsive force generated between a fixed contact and a movable contact by a permanent magnet installed to extinguish an arc.

2. Background of the Invention

Generally, a direct current (DC) relay or a electromagnetic contactor is a type of electric circuit switching apparatus for performing a mechanical driving and transmitting a current signal using a principle of an electromagnet. The DC relay or the electromagnetic contactor is installed at various types of industrial equipment, machines, vehicles, etc.

FIG. 1 is a sectional view of a direct current relay in accordance with the conventional art, and FIG. 2 is an inner perspective view illustrating an upper part of FIG. 1.

The conventional direct current relay includes a lower frame 1, an upper frame 2, a pair of fixed contacts and a pair of movable contacts installed in the upper frame 2, and an electric actuator 5 installed in the lower frame 1 and configured to drive the movable contacts 4 so that a connected state between the fixed contacts 3 and the movable contacts 4 can be switched by an electric signal. Permanent magnets 6*a*, 6*b* are provided in the upper frame 2 so as to effectively control an arc generated when the contacts are separated from each other.

The pair of fixed contacts 3 are configured as a first fixed contact 3*a* and a second fixed contact 3*b*, and have polarities of (+), (−), respectively. The permanent magnets 6*a*, 6*b* installed in the upper frame 2 form a magnetic field (B), and are fixed by a permanent magnet holder (not shown). The magnetic field (B) generated from the permanent magnets 6*a*, 6*b* interacts with a current (+I, −I), thereby generating a force (+f, −f) to push out an arc generated when the contacts are separated from each other. This can reduce damage of a contact part.

However, the conventional direct current relay has the following problems.

Firstly, when the permanent magnets 6*a*, 6*b* for controlling an arc are provided at the direct current relay, a current (I) flows on the movable contacts 4 from a first movable contact 4*a* to a second movable contact 4*b* as shown in FIG. 2. Thus, a force (F) is applied to the movable contacts 4 in a downward direction by Fleming's law. The force (F) is applied in a direction to separate the movable contacts 4 from the fixed contacts 3. Such a force is called an 'electrodynamic repulsion force'. In a normal current state, no problem occurs. However, when an over-current flows due to a fault current, the electrodynamic repulsion force is drastically increased, resulting in separation of the contact part. As a result, the fixed contact 3 and the movable contact 4 are separated from each other, and thus an inferior contact state may be caused.

FIG. 3 illustrates a magnetic flux density in a direct current relay in accordance with the conventional art, which shows a flow of a magnetic field (B) formed by the permanent magnets 6*a*, 6*b*. The magnetic field (B) flows in a direction toward the lower permanent magnet 6*b* from the upper permanent magnet 6*a*. It can be shown that a magnetic flux density within a range between the upper permanent magnet 6*a* and the lower permanent magnet 6*b* is almost constant.

SUMMARY OF THE INVENTION

Therefore, an aspect of the detailed description is to provide a direct current relay capable of reducing an electro repulsive force generated between a fixed contact and a movable contact, by a permanent magnet installed to extinguish an arc.

To achieve these and other advantages and in accordance with the purpose of this specification, as embodied and broadly described herein, there is provided a direct current relay, including: a frame; first and second fixed contacts spaced from each other with a predetermined distance therebetween; first and second magnetic substances formed to enclose a lower part of the first and second fixed contacts; a movable contact movable to contact or to be separated from the first and second fixed contacts, having a first movable contact contactable to the first fixed contact, and having a second movable contact contactable to the second fixed contact; and a pair of permanent magnets installed on long sides of the frame.

The first and second fixed contacts may be formed so that head parts, body parts, and leg parts form steps sequentially. The first and second magnetic substances may be coupled to a circumferential surface of the body parts or the leg parts.

Each of the first and second magnetic substances may be formed to have a 'C' shape.

Open parts of the first and second magnetic substances may be installed so as to be toward outside.

The first and second magnetic substances may be configured as ferromagnetic substances, or may be configured as paramagnetic substances.

The direct current relay according to a first embodiment of the present invention has the following advantage.

A magnetic flux flowing from the permanent magnet is concentrated to the first and second magnetic substances, since the first and second magnetic substances are provided below the first and second fixed contacts. As a result, an electronic repulsive force generated between the fixed contacts and the movable contacts can be reduced by the permanent magnet installed to extinguish an arc.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of preferred configurations of a direct current relay according to the present invention, with reference to the accompanying drawings.

Figure 4:
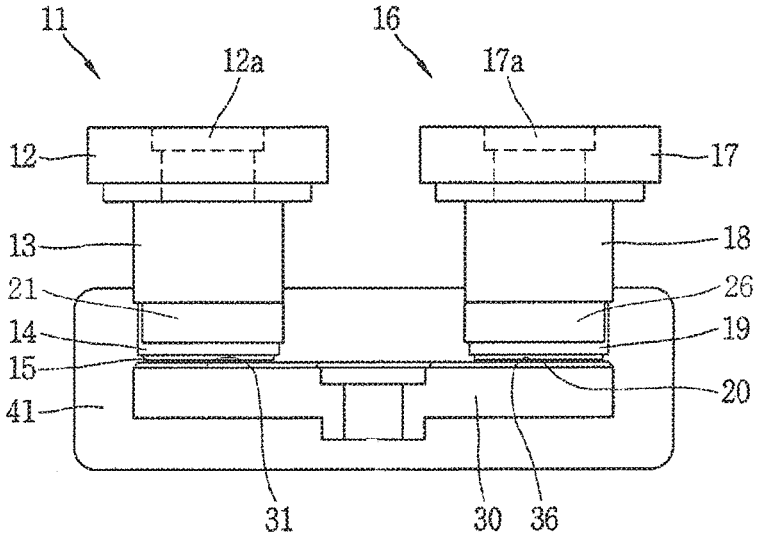
FIG. 4 is a frontal view illustrating an upper part of a direct current relay according to an embodiment of the present invention.
Figure 5:
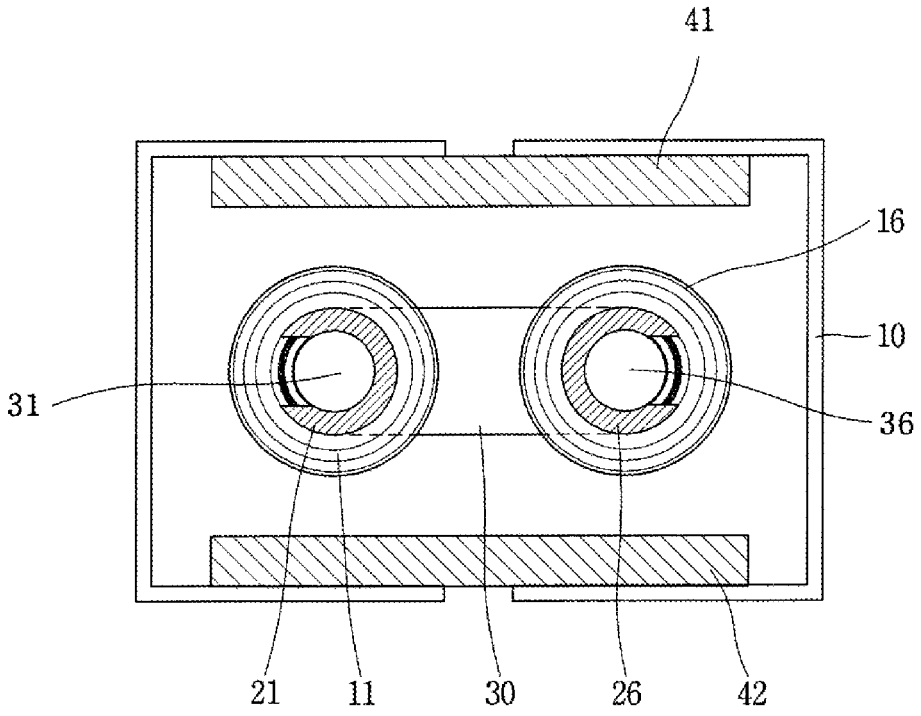
FIG. 5 is a planar view illustrating an upper part of a direct current relay according to an embodiment of the present invention.
Figure 6:
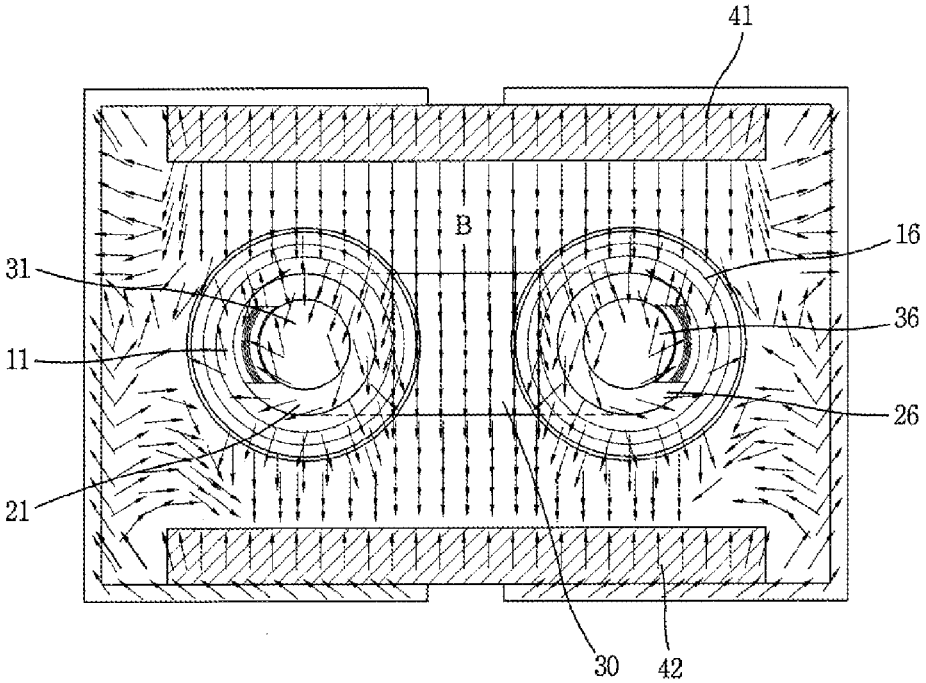
FIG. 6 is a view illustrating a magnetic flux density in FIG. 5.

FIG. 4 is a frontal view illustrating an upper part of a direct current relay according to an embodiment of the present invention, FIG. 5 is a planar view illustrating an upper part of a direct current relay according to an embodiment of the present invention, and FIG. 6 is a view illustrating a magnetic flux density in FIG. 5.

A direct current relay according to an embodiment of the present invention includes a frame 10; first and second fixed contacts 11, 16 installed in a spaced manner with a predetermined distance therebetween; first and second magnetic substances 21, 26 provided to enclose a lower part of the first and second fixed contacts 11,16; a movable contact 30 movable to contact or to be separated from the first and second fixed contacts 11, 16, having a first movable contact 31 contactable to the first fixed contact 11, and having a second movable contact 36 contactable to the second fixed contact 16; and a pair of permanent magnets 41, 42 installed on long sides of the frame 10.

The first and second fixed contacts 11, 16 are installed at the frame 10 in a spaced manner with a predetermined distance therebetween. The first and second fixed contacts 11, 16 are formed of a material having an excellent conductivity, and they may be formed to have the same size and shape. The first and second fixed contacts 11, 16 may be formed so that head parts 12, 17, body parts 13, 18 and leg parts 14, 19 can form steps sequentially.

Terminal grooves 12*a*, 17*a*, which are connectable to a power side or a load side, are formed at the head parts 12, 17.

The body parts 13, 18 and the leg parts 14, 19 are formed to have a cylindrical shape. The body parts 13, 18 and the leg parts 14, 19 may be integrally formed without a step therebetween in an embodiment.

First and second contact parts 15, 20 are formed on a lower surface of the leg parts 14, 19. The first and second contact parts 15, 20 are parts where a current flows as the first and second contact parts 15, 20 come in direct contact with the movable contact 30.

First and second magnetic substances 21, 26 are provided at the leg parts 14, 19. The first and second magnetic substances 21, 26 may be configured as ferromagnetic substances such as iron (Fe), or may be configured as paramagnetic substances such as aluminum (Al). The first and second magnetic substances 21, 26 may be insertion-installed at an outer circumferential surface of the leg parts 14, 19 in the form of rings.

Each of the first and second magnetic substances 21, 26 may be formed to have a 'C' shape. Preferably, open parts of the first and second magnetic substances 21, 26 are installed so as to be toward outside. Under such a configuration, an external influence can be reduced, and an effect to concentrate a magnetic field to the first and second magnetic substances 21, 26 can be enhanced.

The movable contact 30 may be configured as a plate type body. The movable contact 30 contacts or is separated from the first and second fixed contacts 11, 16 with being moved up and down by an actuator (not shown). The movable contact 30 is provided with the first and second movable contacts 31, 36 at contact regions with the first and second contact parts 15, 20.

A pair of permanent magnets 41, 42 are installed on long sides of the frame 10. When viewed from a planar view of FIG. 5, the pair of permanent magnets 41, 42 are installed at two sides on the basis of the first and second fixed contacts 11, 16 and the movable contact 30. The first permanent magnet 41 may be an N-pole, and the second permanent magnet 42 may be an S-pole. A magnetic field (B) is set in a direction toward the second permanent magnet 42 from the first permanent magnet 41.

Figure 1:
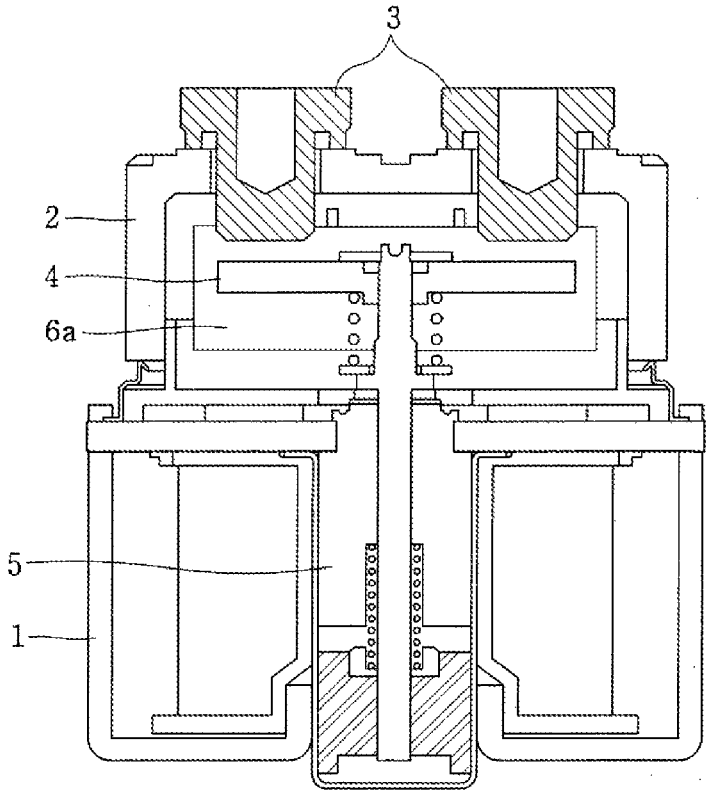
Fig. 1 Prior Art
FIG. 1 is a sectional view of a direct current relay in accordance with the conventional art.
Figure 2:
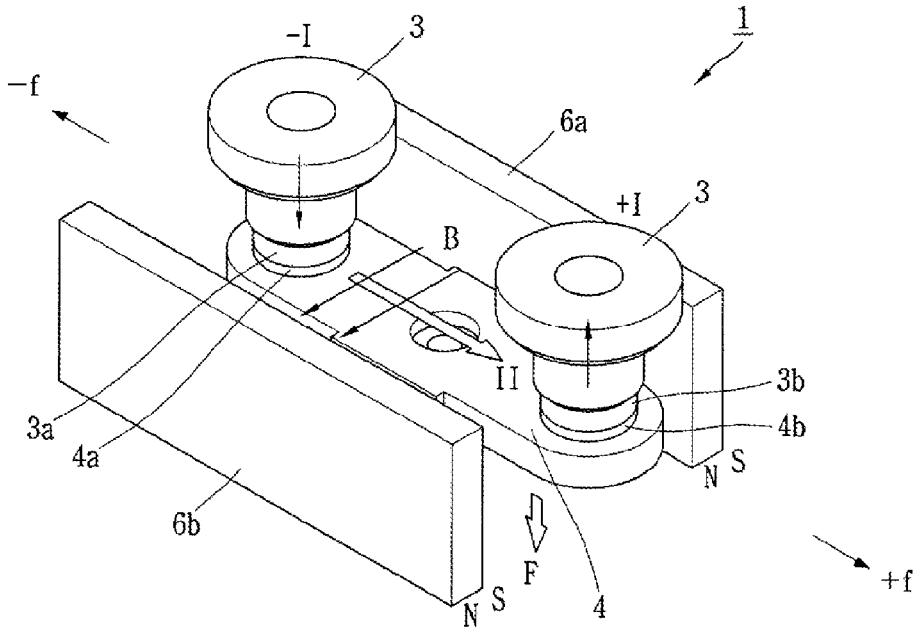
Fig. 2 Prior Art
FIG. 2 is an inner perspective view illustrating an upper part of FIG. 1, which shows a relation of a force applied between a contact part and a permanent magnet.
Figure 3:
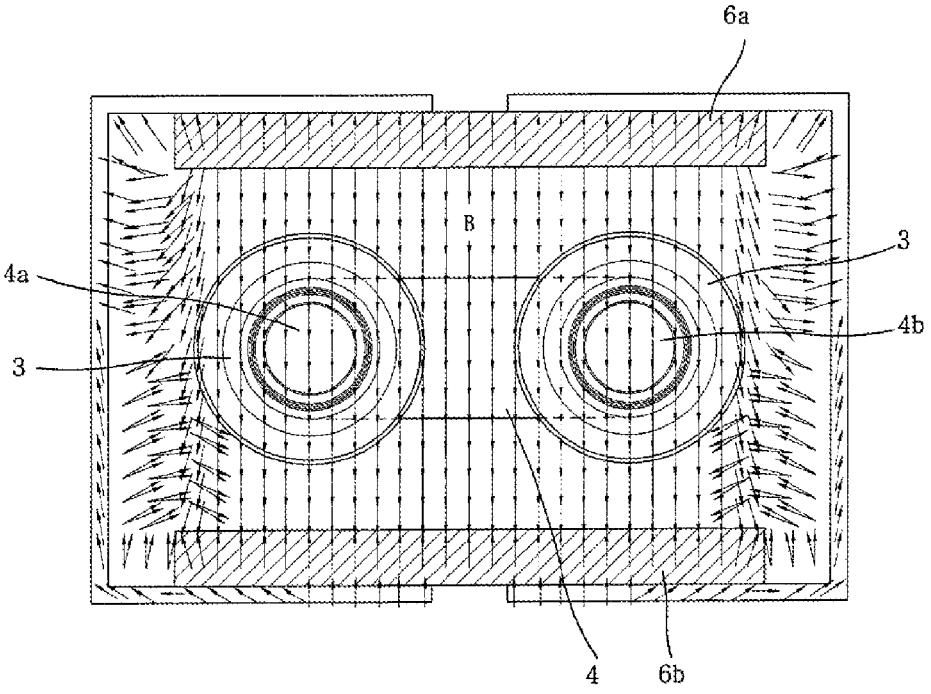
Fig. 3 Prior Art
FIG. 3 is a planar view illustrating a magnetic flux density in FIG. 2.

FIG. 3 illustrates a magnetic flux density in a direct current relay in accordance with the conventional art, and FIG. 6 illustrates a magnetic flux density in a direct current relay according to an embodiment of the present invention.

In the direct current relay according to an embodiment of the present invention, since the first and second magnetic substances 21, 26 are provided in a magnetic field (B) flowing from the first permanent magnet 41 to the second permanent magnet 42, a magnetic flux is concentrated onto the first and second magnetic substances 21, 26. Such a phenomenon occurs intensively around the first and second magnetic substances 21, 26. That is, a magnetic flux generated from the first permanent magnet 41 flows in a direction to concentrate to the first and second magnetic substances 21, 26, and then flows to the second permanent magnet 42. Thus, a magnetic flux flowing to the first and second movable contacts 31,36 is reduced. As a comparison result between FIG. 3 and FIG. 6, it can be shown that a density of a magnetic flux flowing on the first and second movable contacts 31, 36 has been significantly reduced, in the direct current relay according to an embodiment of the present invention. More specifically, a magnetic flux flowing from the first permanent magnet 41 to the second permanent magnet 42 interacts with a current flowing to the first and second movable contacts 31, 36. As a result, the magnetic flux receives a force by Fleming's left-hand law, so that a force to separate the first and second movable contacts 31, 36 from the fixed contacts 11, 16 can be reduced.

In the direct current relay according to an embodiment of the present invention, a magnetic flux flowing from the permanent magnet is concentrated to the first and second magnetic substances, since the first and second magnetic substances are provided below the first and second fixed contacts. As a result, an electronic repulsive force generated between the fixed contacts and the movable contacts can be reduced by the permanent magnet installed to extinguish an arc.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A direct current relay, comprising:

a frame;

a first fixed contact and a second fixed contact spaced a predetermined distance apart;

a first magnetic substance enclosing a lower part of the first fixed contact;

a second magnetic substance enclosing a lower part of the second fixed contact;

a first movable contact configured to contact or separate from the first fixed contact and a second movable contact configured to contact or separate from the second fixed contact; and a pair of permanent magnets installed on long sides of the frame, wherein each of the first magnetic substance and second magnetic substance is formed to have a 'C' shape.

2. The direct current relay of claim 1, wherein:

each of the first fixed contact and second fixed contact is formed to have a head part, a body part, and a leg part that form sequential steps; and each of the first magnetic substance and second magnetic substance is coupled to a circumferential surface of the body part or the leg part of the corresponding fixed contact.

3. The direct current relay of claim 2, wherein each of the first magnetic substance and second magnetic substance is a ferromagnetic substance or a paramagnetic substance.

4. The direct current relay of claim 1, wherein open parts of the each of the first magnetic substance and second magnetic substance are externally oriented.

5. The direct current relay of claim 4, wherein each of the first magnetic substance and second magnetic substance is a ferromagnetic substance or a paramagnetic substance.

6. The direct current relay of claim 1, wherein each of the first magnetic substance and second magnetic substance is a ferromagnetic substance or a paramagnetic substance.

* * * * *